US011658383B2

(12) United States Patent
Chen et al.

(10) Patent No.: US 11,658,383 B2
(45) Date of Patent: May 23, 2023

(54) ANTENNA MOUNTING ASSEMBLY OF BASE STATION ANTENNA

(71) Applicant: CommScope Technologies LLC, Hickory, NC (US)

(72) Inventors: Chen Chen, Jiangsu (CN); Puliang Tang, Jiangsu (CN); Zhaohui Liu, Jiangsu (CN); Zhigang Wang, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/477,883

(22) Filed: Sep. 17, 2021

(65) Prior Publication Data

US 2022/0140465 A1 May 5, 2022

(30) Foreign Application Priority Data

Nov. 3, 2020 (CN) ..... 202022498451.6

(51) Int. Cl.
*H01Q 1/12* (2006.01)
*H01Q 1/24* (2006.01)

(52) U.S. Cl.
CPC ..... *H01Q 1/1228* (2013.01); *H01Q 1/1242* (2013.01); *H01Q 1/1264* (2013.01); *H01Q 1/246* (2013.01)

(58) Field of Classification Search
CPC .. H01Q 1/1228; H01Q 1/1235; H01Q 1/1242; H01Q 1/1264; H01Q 1/246; H01Q 3/06; F16B 2/06
See application file for complete search history.

(56) References Cited

FOREIGN PATENT DOCUMENTS

| | | | |
|---|---|---|---|
| CN | 206789681 U | * | 12/2017 |
| KR | 20100012684 U | * | 12/2010 |
| WO | WO 2019/165800 A1 | * | 6/2019 |

* cited by examiner

*Primary Examiner* — Robert Karacsony
(74) *Attorney, Agent, or Firm* — Myers Bigel, P.A.

(57) ABSTRACT

An antenna mounting assembly of a base station antenna includes: a pole clamp configured to clamp the pole; and a first pivoting arm and a second pivoting arm, a first end portion of the first pivoting arm being pivotally connected to a radome body of the antenna, a second end portion of the second pivoting arm being pivotally connected to the pole clamp, and an opposing second end portion of the first pivoting arm being pivotally connected to an opposing first end portion of the second pivoting arm through a pivoting portion. One of the second end portion of the first pivoting arm and the first end portion of the second pivoting arm is provided with a guide post, and the other is provided with a guide groove.

17 Claims, 4 Drawing Sheets

ANTENNA MOUNTING ASSEMBLY OF BASE STATION ANTENNA

RELATED APPLICATION

The present invention claims priority from and the benefit of Chinese Utility Model Application No. 202022498451.6, filed Nov. 3, 2020, the disclosure of which is hereby incorporated herein by reference in its entirety.

FIELD OF THE INVENTION

The present disclosure relates to the field of base station antennas in general. More specifically, the present disclosure relates to an antenna mounting assembly of a base station antenna.

BACKGROUND OF THE INVENTION

An antenna mounting assembly is used to pivotally mount an antenna to a pole of an antenna tower, so that the tilt angle of the antenna relative to the ground can be adjusted to adjust the main signal coverage areas. More and more electronic components such as filters and remote radio heads have been mounted on the rear portion of the antenna according to market requirement. These electronic parts not only increase the weight of the antenna itself, but also cause the antenna to withstand greater wind load due to its increased size. Therefore, the antenna mounting assembly also bears increasing torque from the antenna accordingly.

The antenna mounting assembly includes two pivoting arms for allowing the antenna to pivot relative to the pole, and a pole clamp connecting the pivoting arms to the pole. Up to now, the two pivoting arms have been designed to be maintained at a fixed angle by the friction generated by the tightening of bolts and nuts. However, the increase in torque makes it difficult to fix the angle by friction, especially under severe conditions (such as in strong wind). In addition, the increase in torque also causes the pole clamp to be easily twisted.

On the other hand, it is necessary to loosen the nut from the bolt when adjusting the angle between the two pivoting arms. However, the loosened nut is easy to come off the bolt to fall on the ground. This brings a lot of trouble to the antenna operation.

SUMMARY OF THE INVENTION

The present disclosure provides an antenna mounting assembly which can overcome at least one of the above-mentioned defects in the prior products.

As a first aspect, embodiments of the present invention are directed to an antenna mounting assembly of a base station antenna. The antenna mounting assembly is configured to pivotally mount an antenna to a pole, and comprises: a pole clamp configured to clamp the pole; and a first pivoting arm and a second pivoting arm, a first end portion of the first pivoting arm being pivotally connected to a radome body of the antenna, a second end portion of the second pivoting arm being pivotally connected to the pole clamp, and an opposing second end portion of the first pivoting arm being pivotally connected to an opposing first end portion of the second pivoting arm through a pivoting portion. One of the second end portion of the first pivoting arm and the first end portion of the second pivoting arm is provided with a guide post, and the other is provided with a guide groove. The guide post is configured to pass through the guide groove and is capable of moving along the guide groove. The guide groove includes two side walls radially opposite to each other. One side wall of the two side walls is provided with a plurality of toothed portions and the other side wall is provided with a smooth surface. The guide post can be placed between adjacent toothed portions of the plurality of toothed portions.

Other features and advantages of the subject technology of the present disclosure will be set forth in the description below, and in part will be apparent from the description, or may be learned by practice of the subject technology of the present disclosure. The advantages of the subject technology of the present disclosure will be realized and attained by the structure particularly pointed out in the written specification and claims hereof as well as the appended drawings.

It should be understood that both the foregoing general description and the following detailed description are exemplary and explanatory and are intended to provide further explanation of the subject technology of the present disclosure as claimed.

BRIEF DESCRIPTION OF THE DRAWINGS

A plurality of aspects of the present disclosure will be better understood after reading the following specific embodiments with reference to the appended drawings. In the appended drawings.

DESCRIPTION OF THE EMBODIMENTS

Figure 1:
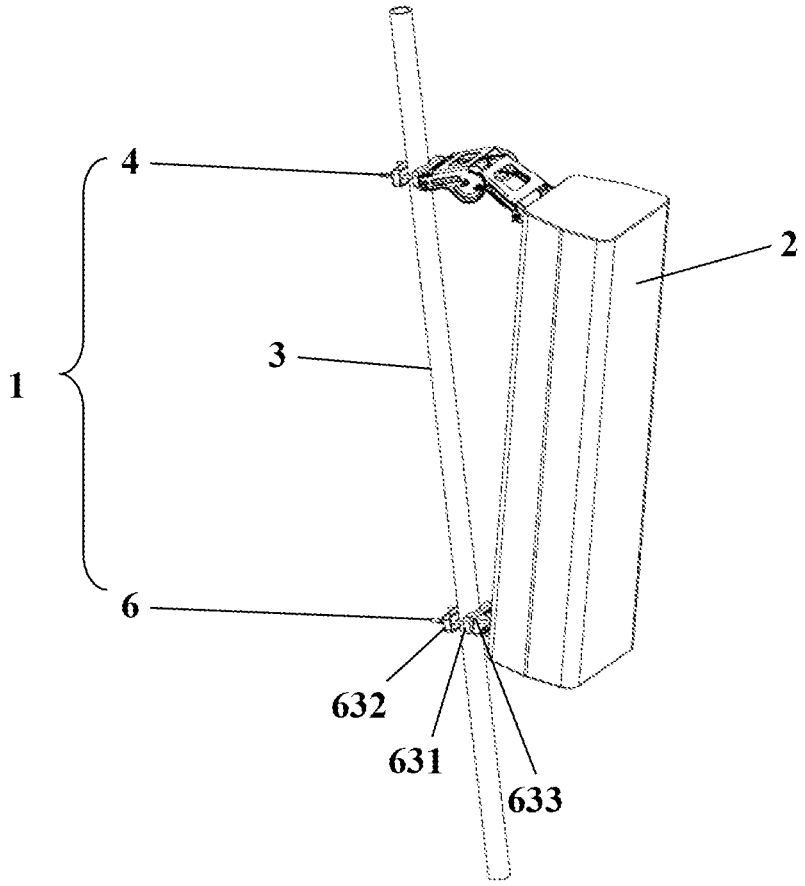
FIG. 1 is a perspective view of a mounting assembly set according to an embodiment of the present disclosure.

The present disclosure will be described below with reference to the appended drawings, and the appended drawings illustrate several embodiments of the present disclosure. However, it should be understood that the present disclosure may be presented in many different ways and is not limited to the embodiments described below; in fact, the embodiments described below are intended to make the disclosure of the present disclosure more complete and to fully explain the protection scope of the present disclosure to those skilled in the art. It should also be understood that the embodiments disclosed in the present disclosure may be combined in various ways so as to provide more additional embodiments.

It should be understood that in all the accompanying drawings, the same reference numerals and signs denote the same elements. In the accompanying drawings, the dimensions of certain features can be changed for clarity.

It should be understood that the words in the specification are only used to describe specific embodiments and are not intended to limit the present disclosure. Unless otherwise defined, all terms (including technical terms and scientific terms) used in the specification have the meanings commonly understood by those skilled in the art. For brevity and/or clarity, well-known functions or structures may not be described further in detail.

The singular forms "a", "an", "the" and "this" used in the specification all include plural forms unless clearly indicated. The words "comprise", "contain" and "have" used in the specification indicate the presence of the claimed features, but do not exclude the presence of one or more other features. The word "and/or" used in the specification includes any or all combinations of one or more of the related listed items. The words "between X and Y" and "between approximate X and Y" used in the specification shall be interpreted as including X and Y. The words "between approximate X and Y" and "from approximate X to Y" used in the specification means "between approximate X and approximate Y" and "from approximate X to approximate Y", respectively.

In the specification, when it is described that an element is "on" another element, "attached" to another element, "connected" to another element, "coupled" to another element, or "in contact with" another element, etc., the element may be directly on another element, attached to another element, connected to another element, coupled to another element, or in contact with another element, or an intermediate element may be present. In contrast, if an element is described "directly" "on" another element, "directly attached" to another element, "directly connected" to another element, "directly coupled" to another element or "directly contacting" another element, there will be no intermediate elements. In the specification, a feature that is arranged "adjacent" to another feature, may denote that a feature has a part that overlaps an adjacent feature or a part located above or below the adjacent feature.

In the specification, words expressing spatial relations such as "upper", "lower", "left", "right", "front", "rear", "top", and "bottom" may describe the relation between one feature and another feature in the accompanying drawings. It should be understood that, in addition to the orientations shown in the accompanying drawings, the words expressing spatial relations further include different orientations of a device in use or operation. For example, when a device in the accompanying drawings rotates reversely, the features originally described as being "below" other features now can be described as being "above" the other features. The device may also be oriented in other directions (rotated by 90 degrees or in other orientations), and in this case, a relative spatial relation will be explained accordingly.

FIG. 1 is a perspective view of a mounting assembly set 1 according to an embodiment of the present disclosure. As shown in the drawing, the mounting assembly set 1 is used to pivotally mount an antenna 2 to a pole 3, and includes an upper mounting assembly 4 and a lower mounting assembly 6 which are separated from each other. The upper mounting assembly 4 is used to pivotally connect a vertical upper part of the antenna 2 to the pole 3, and the lower mounting assembly 6 is used to pivotally connect a vertical lower part of the antenna 2 to the pole 3.

Figure 2A:
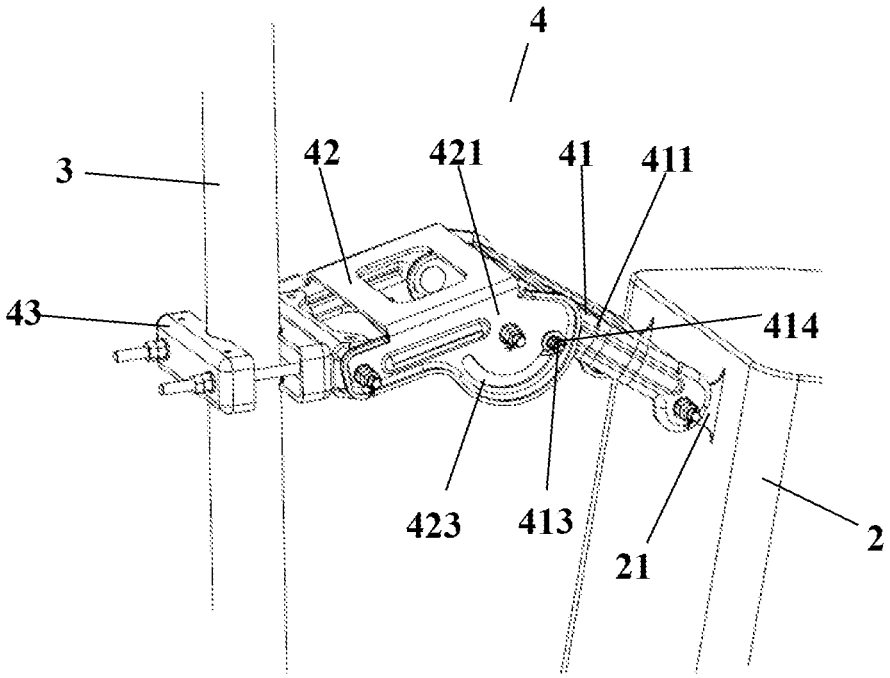
FIGS. 2A and 2B are an assembly perspective view and a distribution exploded perspective view of an upper mounting assembly.
Figure 2B:
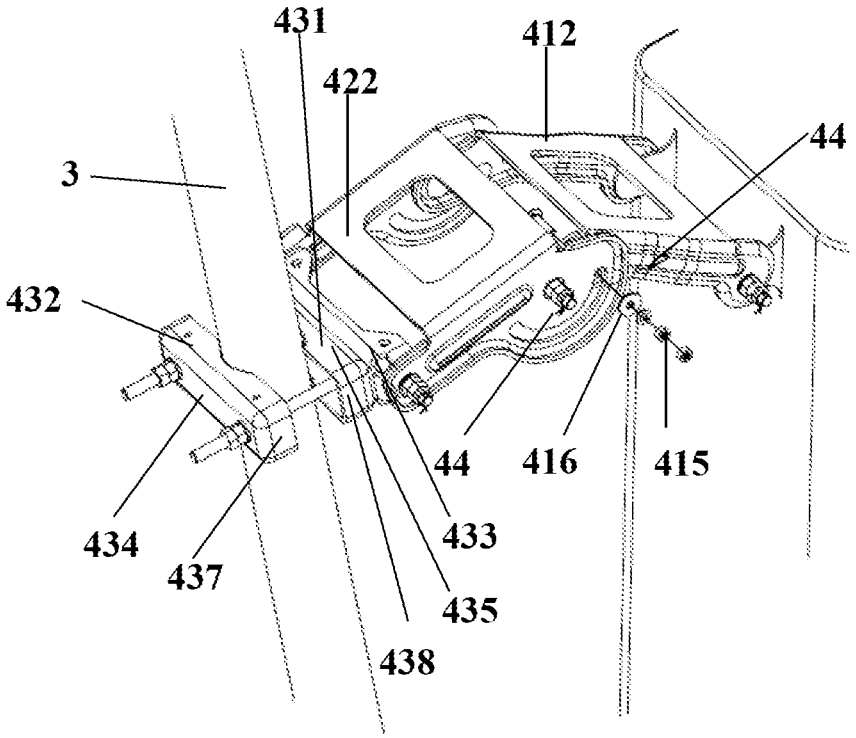

FIGS. 2A and 2B are an assembly perspective view and a partial exploded perspective view of the upper mounting assembly 4. The upper mounting assembly 4 includes a pivoting arm 41, a pivoting arm 42, and a pole clamp 43 connected end to end. The pole clamp 43 firmly clamps the pole 3, and the pivoting arms 41 and 42 pivotally connect a radome body of the antenna 2 to the pole clamp 43. The pivoting arm 41 include two connecting plates 411 aligned in parallel with each other and spaced apart, and a web plate 412 connecting the two connecting plates 411. Similarly, the pivoting arm 42 include two connecting plates 421 aligned in parallel with each other and spaced apart, and a web plate 422 connecting the two connecting plates 421.

A first end portion of each connecting plate 411 of the pivoting arm 41 is connected to an upper protruding portion 21 on the radome body of the antenna 2 through a pivoting portion, an opposing second end portion is connected to a first end portion of a corresponding connecting plate 421 of the pivoting arm 42 through the pivoting portion, and an opposing second end portion of the connecting plate 421 is connected to the pole clamp 43 through the pivoting portion. The pivoting portion can be provided in various forms, and description will be made below taking the connecting plates 411 and 421 as an example. However, it should be understood that the pivoting portion can be applied to pivotal connections between other components. In one form of pivoting portion, a pivot hole is provided in both the second end portion of the connecting plate 411 and the first end portion of the connecting plate 421, and an additional pivot can pass through the two aligned pivot holes to pivotally connect the connecting plate 411 and the connecting plate 421 together. In another form of pivoting portion, one of the second end portion of the connecting plate 411 and the first end portion of the connecting plate 421 is provided with a pivot hole while the other is provided with a pivot, and the pivot passes through the pivot hole to pivotally connect the connecting plate 411 and the connecting plate 421 together.

A guide post 413 protruding outward is provided on the outer surface of each connecting plate 411 of the pivoting arm 41. The guide posts 413 are respectively located between the pivot hole (or pivot) of the first end portion and the pivot hole (or pivot) of the second end portion of the connecting plate 411, and are closer to the pivot hole (or pivot) of the second end portion. An arc-shaped guide groove 423 is provided in each connecting plate 421 of the pivoting arm 42 around the pivot hole (or pivot) of the first end portion. The two connecting plates 411 of the pivoting arm 41 are positioned between the two connecting plates 421 of the pivoting arm 42, and the guide posts 413 on the connecting plates 411 respectively pass through the guide grooves 423 on the connecting plates 421 to extend outward. When the pivoting arms 41 and 42 pivot around the pivoting portion, the guide post 413 can move along the guide groove 423 within the guide groove 423.

In some embodiments, the two connecting plates 421 of the pivoting arm 42 may also be positioned between the two connecting plates 411 of the pivoting arm 41, and the guide post 413 may extend inward from the inner surface of the connecting plate 411 of the pivoting arm 41 and pass through the guide groove 423 on the connecting plate 421. In some embodiments, the guide post may be provided on the connecting plate 421 of the pivoting arm 42 instead of the connecting plate 411 of the pivoting arm 41, and the guide groove may be provided on the connecting plate 411 of the pivoting arm 41 instead of the connecting plate 421 of the pivoting arm 42. In some embodiments, the pivoting arms 41 and 42 may include one guide post and one guide groove only on one connecting plate instead of including two guide posts and two guide grooves on two connecting plates, respectively.

Figure 3A:
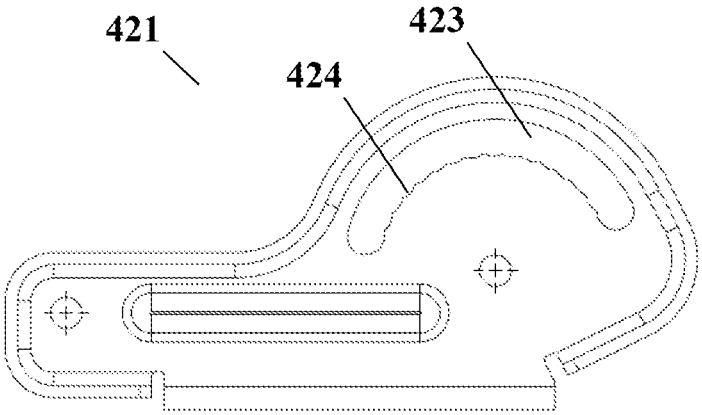
FIGS. 3A and 3B are a plan view and a sectional view of a pivoting arm of the upper mounting assembly.
Figure 3B:
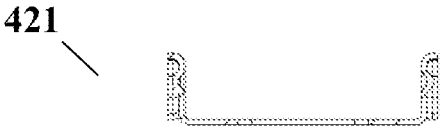

As shown in FIG. 3A, the guide groove 423 is configured to pass through a through groove of the connecting plate 421 and is in a substantially elongated circular arc shape surrounding the pivot hole (or pivot) of the first end portion of the connecting plate 421. The guide groove 423 includes a radially inner side wall and a radially outer side wall opposite to each other. A continuous toothed portion 424 is provided on the entire radially inner side wall. After the angle between the pivoting arms 41 and 42 is adjusted, the guide post 413 can be placed between the adjacent toothed portions 424 to be fixed in position in the guide groove 423. This can prevent the guide post 413 from sliding relative to the guide groove 423 under any severe conditions (such as in strong wind) to cause a change in the angle between the pivoting arms 41 and 42. The teeth of the toothed portion 424 may be provided to have various different cross-sectional shapes, such as a triangle, a trapezoid, and a circular arc. The radially outer side wall of the guide groove 423 is provided with a smooth surface. When the angle between the pivoting arms 41 and 42 needs to be adjusted, the guide post 413 can move away from the toothed portion 424 and approach the radially outer side wall or directly abut against the radially outer side wall. The guide post 413 can move along the smooth outer surface of the radially side wall without being interfered by the toothed portion 424, thereby facilitating the adjustment of the angle between the pivoting arms 41 and 42.

In some embodiments, the toothed portion may be provided on a part of the radially inner side wall (for example, the central part of the radially inner side wall) instead of the entire radially inner side wall. In some embodiments, the toothed portion may be provided on the radially outer side wall instead of the radially inner side wall, and the smooth surface may be provided on the radially inner side wall instead of the radially outer side wall.

As shown in FIGS. 2A and 2B, the guide post 413 may include a bolt 414, a nut 415, and a washer 416. The bolt 414 is used to guide the connecting plate 411 to pivot in the guide groove 423 relative to the connecting plate 421, and the nut 415 and the washer 416 are used to tighten the bolt 414 on the connecting plates 411 and 421. The bolt 414 includes a screw rod and a head portion at an end portion of the screw rod. The head portion abuts against the connecting plate 411, and the screw rod passes through the through hole on the connecting plate 411 and the guide groove 423 on the connecting plate 421 and is then screwed into the washer 416 and the nut 415.

Figure 4A:
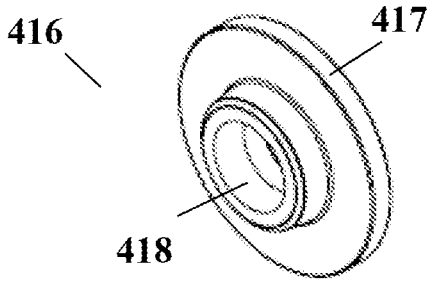
FIGS. 4A and 4B are perspective views of different examples of a washer of the upper mounting assembly.

As shown in FIG. 4A, the washer 416 includes a main body 417 with a central hole, and a flange 418 protruding outward around the central hole. The flange 418 may surround the screw rod of the bolt 414 and be placed between adjacent toothed portions 424 of the guide groove 423 to prevent the bolt 414 from sliding relative to the guide groove 423 to cause a change in the angle between the pivoting arms 41 and 42 on one hand, and to prevent the screw rod of the bolt 414 from directly contacting the toothed portion 424 and damaging the screw thread on the other hand.

When the angle between the pivoting arms 41 and 42 needs to be adjusted, the nut 415 is loosened from the bolt 414, and the washer 416 and the nut 415 are spaced apart from the connecting plate 421 so that the bolt 414 can move in the guide groove 423. After the angle between the pivoting arms 41 and 42 is adjusted, the flange 418 of the washer 416 is placed around the bolt 414 and between the adjacent toothed portions 424 of the guide groove 423, and the nut 415 is tightened on the bolt 414 to make the connecting plates 411 and 421 fit closely and to fix the angle between the pivoting arms 41 and 42.

Figure 4B:
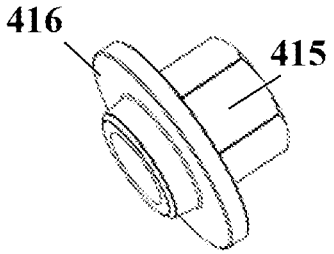

The nut 415 and the washer 416 are two separate parts. In some embodiments, as shown in FIG. 4B, the nut 415 and the washer 416 may be integrally formed, and the nut 415 may be located on a side of the main body 417 that is opposite to the flange 418.

Figure 5:
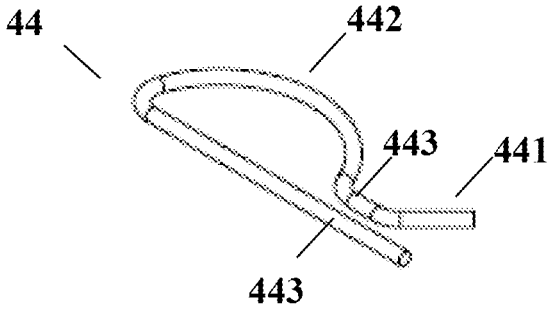
FIG. 5 is a perspective view of a retaining clip of the upper mounting assembly.

As shown in FIGS. 2A and 2B, an retaining clip 44 may be clamped on the screw rod of the bolt 414 and located on the outer side of the nut 415 to prevent the nut 415 from coming off the bolt 414 due to looseness. As shown in FIG. 5, the retaining clip 44 includes an opening portion 441 and a surrounding portion 442 connected to each other. The opening portion 441 allows the screw rod to enter or exit the surrounding portion 442, and the surrounding portion 442 is clamped on the screw rod to prevent the nut 415 from coming off the screw rod. The retaining clip 44 may be formed by bending a slender wire, or may be formed by a perforated sheet material.

The surrounding portion 442 has a through hole at its center, and the screw rod may be placed in the through hole. The diameter of the through hole is set to be greater than the diameter of a bottom portion of a thread and smaller than the diameter of a top portion of the thread of the screw rod, so that the surrounding portion 442 can be clamped between two adjacent threads of the screw rod. The opening portion 441 includes two opposing arms 443. The two arms 443 have elasticity so that they can be switched between an initial state and an opened state. In the initial state, the two elastic arms 443 are in contact with each other or spaced apart with a minimum distance smaller than the diameter of the screw rod to prevent the screw rod placed in the surrounding portion 442 from escaping from the surrounding portion 442 in a direction transverse to its central axis. In the opened state, the two elastic arms 443 can be opened apart from each other with a distance greater than the diameter of the screw rod to allow the screw rod to enter and exit the surrounding portion 442, and return to the initial state under the action of elastic force after the screw rod passes through. In some embodiments, the retaining clip 44 may also be applied to other places in addition to the guide post 413, such as the pivot between the pivoting arm 41 and the pivoting arm 42, to prevent the nut on the pivot from coming off.

As shown in FIGS. 2A and 2B, the pole clamp 43 includes two clamping jaws 431 and 432 opposite to each other, and a connecting piece 433 connected to the clamping jaw 431. The two clamping jaws 431 and 432 are used to clamp the pole clamp 43, and the connecting piece 433 is used to pivotally connect the pivoting arm 42 to the clamping jaw 431. The clamping jaws 431 and 432 include elongated main bodies 434 and 435, and the main bodies 434 and 435 have substantially U-shaped cross sections. Two free arms of the U shape abut against the pole 3. Reinforcing pieces 437 and 438 are provided between the two free arms of the clamping jaws 431 and 432 respectively to increase the strength of the entire clamping jaws and prevent the clamping jaws from deforming and failing under any extreme loading conditions. The clamping jaws 431 and 432 are respectively provided with at least two through holes at the bottom of the U-shaped main bodies, and bolts can pass through the through holes to connect the clamping jaws 431 and 432 together on both sides of the pole 43. The connecting piece 433 is fixed to the clamping jaw 431 by welding, screws, etc., and is provided with protrusions protruding outward at both ends of the connecting piece. The protrusions may be connected to the second end portion of the connecting plate 421 through various types of pivoting portion described above.

As shown in FIG. 1, the lower mounting assembly 6 includes a pole clamp 63. The structure of the pole clamp 63 is substantially the same as the structure of the pole clamp 43. The pole clamp 63 includes two clamping jaws 631 and 632 opposite to each other, and a connecting piece 633 connected to the clamping jaw 631, and the connecting piece 633 is provided with protrusions protruding outward at both ends of the connecting piece. The protrusions may be connected to a pair of lower protruding portions on the radome body of the antenna 2 through various types of pivoting portion described above.

The guide groove of the upper mounting assembly according to the present disclosure has two opposing surfaces, where one of the two surfaces has a toothed portion and the other is a smooth surface. When adjusting the angle between the two pivoting arms, the smooth surface may be used to allow the guide post to move through the guide groove. When fixing the angle between the pivoting arms, the toothed portion on the other side may be used to keep the guide post stationary relative to the guide groove.

The bolt of the upper mounting assembly according to the present disclosure are provided with a washer having a flange. The flange is placed between adjacent toothed portions of the guide groove to prevent the bolt from sliding relative to the guide groove to cause a change in the angle between the connecting plates on one hand, and to prevent the bolt from directly contacting the toothed portion and damaging the screw thread on the other hand.

A retaining clip is clamped on the bolt of the upper mounting assembly according to the present disclosure. The retaining clip is clamped on the screw rod of the bolt and is located on the outer side of the nut to prevent the nut from coming off the bolt due to looseness.

The clamping jaws of the pole clamp of the upper mounting assembly according to the present disclosure are provided with a reinforcing piece to increase the strength of the entire clamping jaws and prevent the clamping jaws from deforming and failing under any extreme loading conditions.

Although the exemplary embodiments of the present disclosure have been described, it should be understood by those skilled in the art that a plurality of variations and changes can be created and made to the exemplary embodiments of the present disclosure without essentially departing from the spirit and scope of the present disclosure. Therefore, all variations and changes are included in the protection scope of the present disclosure defined by the claims. The present disclosure is defined by the attached claims, and equivalents of these claims are also included.

The invention claimed is:

1. An antenna mounting assembly of a base station antenna, the antenna mounting assembly being configured to pivotally mount an antenna to a pole, the antenna mounting assembly comprising:

a pole clamp configured to clamp the pole; and a first pivoting arm and a second pivoting arm, a first end portion of the first pivoting arm being pivotally connected to a radome body of the antenna, a second end portion of the second pivoting arm being pivotally connected to the pole clamp, and an opposing second end portion of the first pivoting arm being pivotally connected to an opposing first end portion of the second pivoting arm through a pivoting portion;

wherein one of the second end portion of the first pivoting arm and the first end portion of the second pivoting arm is provided with a guide post, and the other is provided with a guide groove, the guide post is configured to pass through the guide groove and be capable of moving along the guide groove, the guide groove includes two side walls radially opposite to each other, one side wall of the two side walls is provided with a plurality of toothed portions and the other side wall is provided with a smooth surface, and the guide post can be placed between adjacent toothed portions of the plurality of toothed portions.

2. The antenna mounting assembly according to claim 1, wherein the guide groove is in a substantially elongated arc shape around the pivoting portion of the first pivoting arm and the second pivoting arm.

3. The antenna mounting assembly according to claim 1, wherein both the first pivoting arm and the second pivoting arm include two connecting plates aligned in parallel with each other and spaced apart, and a web plate connecting the two connecting plates, wherein the guide post is provided on one of a second end portion of the connecting plate of the first pivoting arm and a first end portion of the connecting plate of the second pivoting arm, and the guide groove is provided on the other of the second end portion of the connecting plate of the first pivoting arm and the first end portion of the connecting plate of the second pivoting arm.

4. The antenna mounting assembly according to claim 1, wherein the plurality of toothed portions is provided on a part of the one side wall, or provided on the entire one side wall.

5. The antenna mounting assembly according to claim 1, wherein teeth in each toothed portion in the plurality of toothed portions have a cross-sectional shape selected from a group consisting of a triangle, a trapezoid, and a circular arc.

6. The antenna mounting assembly according to claim 1, wherein the guide post includes a bolt, a nut and a washer screwed on the bolt, and the washer includes a main body with a central hole, and a flange protruding outward around the central hole.

7. The antenna mounting assembly according to claim 6, wherein the flange is configured to surround a screw rod of the bolt and to be placed between adjacent toothed portions of the guide groove.

8. The antenna mounting assembly according to claim 6, wherein the nut and the washer are two separate parts.

9. The antenna mounting assembly according to claim 6, wherein the nut and the washer are integrally formed, and the nut is located on a side of the main body that is opposite to the flange.

10. The antenna mounting assembly according to claim 6, wherein the mounting assembly further includes a retaining clip which is configured to be clamped on the guide post or on a pivot of the pivoting portion to prevent the nut screwed on the guide post or the pivot from coming off the guide post or the pivot.

11. The antenna mounting assembly according to claim 10, wherein the retaining clip includes an opening portion and a surrounding portion connected to each other, the surrounding portion is configured to be clamped on the guide post or the pivot, and the opening portion is configured to allow the guide post or the pivot to enter and exit the surrounding portion.

12. The antenna mounting assembly according to claim 11, wherein the surrounding portion has a through hole at its center, and the through hole has a diameter greater than the diameter of a bottom portion of a thread and smaller than the diameter of a top portion of the thread of the guide post or the pivot, so that the surrounding portion can be clamped between two adjacent threads of the guide post or the pivot.

13. The antenna mounting assembly according to claim 11, wherein the opening portion includes two opposing elastic arms and the two elastic arms can be switched between an initial state and an opened state, where in the initial state, the two elastic arms are in contact with each other or spaced apart with a minimum distance smaller than the diameter of the guide post or the pivot, and in the opened state, the two elastic arms are opened apart from each other with a distance greater than the diameter of the guide post or the pivot.

14. The antenna mounting assembly according to claim 10, wherein the retaining clip is formed by bending a slender wire.

15. The antenna mounting assembly according to claim 10, wherein the retaining clip is formed by a perforated sheet material.

16. The antenna mounting assembly according to claim 1, wherein the pole clamp includes two clamping jaws opposite to each other, at least one of the two clamping jaws includes an elongated main body having a substantially U-shaped cross section, two free arms of the U shape abut against the pole, and a reinforcing piece is provided between the two free arms.

17. An antenna mounting assembly set of a base station antenna, the antenna mounting assembly set being configured to pivotally mount an antenna to a pole, wherein the antenna mounting assembly set includes:

the antenna mounting assembly according to claim 1, wherein the antenna mounting assembly is configured to pivotally mount an upper part of the antenna to the pole; and a second antenna mounting assembly which is configured to pivotally mount a lower part of the antenna to the pole and includes a second pole clamp, wherein the second clamp pole includes two second clamping jaws opposite to each other, at least one of the two second clamping jaws includes an elongated second main body having a substantially U-shaped cross section, two second free arms of the U shape abut against the pole, and a second reinforcing piece is provided between the two second free arms.

* * * * *